US010779631B2

(12) United States Patent
Lee

(10) Patent No.: US 10,779,631 B2
(45) Date of Patent: Sep. 22, 2020

(54) COSMETIC STAMP AND METHOD OF USING SAME

(71) Applicant: Kiss Nail Products, Inc., Port Washington, NY (US)

(72) Inventor: Youlmae Lee, Port Washington, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 46 days.

(21) Appl. No.: 15/345,853

(22) Filed: Nov. 8, 2016

(65) Prior Publication Data

US 2017/0295908 A1 Oct. 19, 2017

Related U.S. Application Data

(60) Provisional application No. 62/321,884, filed on Apr. 13, 2016.

(51) Int. Cl.
*A45D 40/26* (2006.01)
*B41K 1/04* (2006.01)
(Continued)

(52) U.S. Cl.
CPC ..... *A45D 40/26* (2013.01); *A45D 40/30* (2013.01); *B41K 1/006* (2013.01); *B41K 1/04* (2013.01);
(Continued)

(58) Field of Classification Search
CPC ..... A45D 2040/0012; A45D 40/24; A45D 40/30; A45D 40/26; A45D 33/18;
(Continued)

(56) References Cited

U.S. PATENT DOCUMENTS 2,998,821 A * 9/1961 Hurdel ..... A45D 40/30 132/218
4,600,328 A * 7/1986 Clements ..... A45D 40/24 132/218
(Continued)

FOREIGN PATENT DOCUMENTS

CN 201471865 5/2010
CN ZL2017200965437 1/2017
(Continued)

OTHER PUBLICATIONS

English translation of Office Action and Search Report dated Sep. 4, 2017 of Taiwanese Patent Application No. 106100179.
(Continued)

*Primary Examiner* — Cris L. Rodriguez
*Assistant Examiner* — Brianne E Kalach
(74) *Attorney, Agent, or Firm* — Cherskov Flaynik & Gurda, LLC

(57) ABSTRACT

A cosmetic stamp includes one or more stamping elements, a stamp compartment or housing for carrying the one or more stamping elements and a stamping substance. For example, a cosmetic stamp is an eyebrow stamp that is used for the application of a cosmetic eyebrow using the one or more stamping elements and the stamping substance. A method of applying a cosmetic stamp includes removing a stamping element from a stamp compartment, opening a lid of the stamp compartment, and pressing the face of the stamp to a stamping substance.

15 Claims, 11 Drawing Sheets

(51) Int. Cl.

| | |
|---|---|
| ***B41K 1/50*** | (2006.01) |
| ***A45D 40/30*** | (2006.01) |
| ***B41K 1/00*** | (2006.01) |
| ***B41K 1/08*** | (2006.01) |
| ***B41K 1/26*** | (2006.01) |
| ***B41K 1/54*** | (2006.01) |
| ***B41K 1/56*** | (2006.01) |
| ***B41K 1/58*** | (2006.01) |

(52) U.S. Cl.
CPC ..... *B41K 1/08* (2013.01); *B41K 1/26* (2013.01); *B41K 1/50* (2013.01); *B41K 1/54* (2013.01); *B41K 1/56* (2013.01); *B41K 1/58* (2013.01)

(58) Field of Classification Search
CPC ..... A45D 33/24; B49L 9/12; B41K 1/006; B41K 1/58; B41K 1/54
USPC ..... 220/507; 101/372; 206/481.5, 823, 214, 206/371
See application file for complete search history.

(56) References Cited

U.S. PATENT DOCUMENTS

| | | | | |
|---|---|---|---|---|
| 4,791,695 | A * | 12/1988 | Kephart | A46B 9/02 101/372 |
| 6,120,202 | A * | 9/2000 | Donsky | A45D 34/045 401/17 |
| 7,180,480 | B2 | 2/2007 | Lee et al. | |
| 8,051,860 | B1 * | 11/2011 | Pereira | A45D 40/30 101/405 |
| 2002/0003983 | A1 * | 1/2002 | Gueret | A45D 33/00 401/130 |
| 2004/0109088 | A1 | 6/2004 | Lee et al. | |
| 2005/0050662 | A1 * | 3/2005 | Williams | A45D 33/36 15/143.1 |
| 2006/0130868 | A1 | 6/2006 | Noel | |
| 2008/0138138 | A1 * | 6/2008 | Gueret | A45D 34/04 401/24 |
| 2008/0250956 | A1 * | 10/2008 | McSweeney | B41K 1/006 101/327 |
| 2010/0322694 | A1 * | 12/2010 | Kim | A45D 40/24 401/35 |
| 2015/0083158 | A1 | 3/2015 | Abraham et al. | |
| 2016/0338470 | A1 * | 11/2016 | Klapia | A45D 40/24 |

FOREIGN PATENT DOCUMENTS

| | | | |
|---|---|---|---|
| GB | 2152368 | A | 8/1985 |
| JP | 53-64661 | U | 4/1998 |
| JP | H10-094426 | A | 4/1998 |
| JP | 2002512105 | | 4/2002 |
| JP | 2002512105 | A | 4/2002 |
| JP | 2012-010754 | A | 1/2012 |
| KR | 2000-0018916 | | 10/2000 |
| KR | 2020000018916 | | 10/2000 |
| KR | 2020000018916 | U | 10/2000 |
| KR | 200253696 | | 11/2001 |
| KR | 200253696 | Y1 | 11/2001 |
| KR | 200300044 | | 11/2001 |
| KR | 20-0259128 | * | 12/2001 |
| KR | 200259128 | | 12/2001 |
| KR | 200259128 | Y1 | 12/2001 |
| KR | 20-0275299 | | 4/2002 |
| KR | 20-0275299 | Y1 | 5/2002 |
| KR | 200300044 | Y1 | 1/2003 |
| KR | 2003-0033637 | A | 5/2003 |
| KR | 1020090092069 | | 8/2009 |
| KR | 1020090092069 | A | 8/2009 |
| KR | 2020150002617 | | 7/2015 |
| KR | 2020150002617 | U | 7/2015 |
| WO | 2015042538 | A1 | 3/2015 |
| WO | WO 2015042538 | * | 3/2015 |
| WO | 2015/189527 | A1 | 12/2015 |

OTHER PUBLICATIONS www.stampmefabulous.com.
www.stampmefabulous.com/home.shtml.
www.stampmefabulous.com/how_to_use_eyebrow.shtml.
Chinese Patent Application for Chinese Application No. 201720096543.7.
First Office Action for Chinese Application No. 201720096543.7 dated Jul. 28, 2017.
Response to First Office Action for Chinese Application No. 201720096543.7 dated Sep. 13, 2017.
Second Office Action for Chinese Application No. 201720096543.7 dated Sep. 27, 2017.
Response to Second Office Action for Chinese Application No. 201720096543.7 dated Oct. 10, 2017.
Notice of Allowance for Chinese Application No. 201720096543.7 dated Oct. 25, 2017.
Allowed Claims for Chinese Application No. 201720096543.7.
First Korean Office Action dated Jun. 15, 2017 for Korean Patent Application No. 10-2016-0150564.
Amendment to First Korean Office Action for Korean Patent Application No. 10-2016-0150564.
Argument Brief for First Korean Office Action for Korean Patent Application No. 10-2016-0150564.
Final Korean Office Action dated Aug. 21, 2017 for Korean Patent Application No. 10-2016-0150564.
Amendment to Final Korean Korean Office Action dated Aug. 21, 2017 for Korean Patent Application No. 10-2016-0150564.
Argument Brief for Final Korean Korean Office Action for Korean Patent Application No. 10-2016-0150564.
Notice of Allowance dated Sep. 20, 2017 for Korean Patent Application No. 10-2016-0150564.
Web-published post on the product "Lovely Mix Love Mark Tint" manufactured by "The FACESHOP" [Retrieved from the internet] https://blog.naver.com/PostView.nhn?blogId=eunmam67&logNo+401658351928&rediect-Dlog&widgetTypeCall=true&directAccess=f . . . .
A Youtube video clip on an eyelash stamping tool manufactured by "Wings Cosmetics" [Retrieved from the internet] "WINGS Cosmetics New Eyeliner Stamp—Dramatic Tool," https:www.youtue.com/watch?v=FZsNHgUgnno.
The product "12 Universal Operating Perfect Eyebrow Embroidery Tattoo Inks Lines Painted Eyebrows Stencil MHE-01" [Retrieved from the Internet] https://www.dhgate.com/product/12-universal-operating-perfect-eyebrow-embroidery . . . .
International Search Report and Written Opinion issued in counterpart International Application No. PCT/US2017/021497 dated Jun. 5, 2017.
Korean Office Action issued in counterpart Korean Application No. 10-2017-0116584 dated Jan. 22, 2018.

* cited by examiner

COSMETIC STAMP AND METHOD OF USING SAME

CROSS-REFERENCE TO RELATED APPLICATIONS

This application claims the benefit of U.S. Provisional Application No. 62/321,884, filed on Apr. 13, 2016, which is incorporated herein by reference in its entirety for all purposes.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

The following description relates to a cosmetic stamp including one or more stamping elements, a stamp compartment for carrying the one or more stamping elements and a stamping substance. Also, a method of using a cosmetic stamp is described. For example, a cosmetic stamp is an eyebrow stamp that is used for the application of a left and right cosmetic eyebrow using two stamping elements and a stamping substance.

2. Related Art

Cosmetic stamps are typically used by consumers for a number of different applications such as stamping a cosmetic eyebrow, a cosmetic lip, or a cosmetic mustache. In applying a cosmetic stamp, a user will typically purchase a stamp having a particular design, a stamp application pen for applying ink to the stamp, and a container for holding the stamp. These devices can be sold separately and provided in separate containers. To apply the stamp, the user typically performs an involved process of applying ink to the face of the cosmetic stamp using a stamp application pen.

After use and wear of a cosmetic stamp, the cosmetic stamp is usually cleaned using an involved process. The eyebrow design may be removed from its base and cleaned with soap and water. An eyebrow brush is usually provided for cleaning the eyebrow stamp. The eyebrow stamp must then be reattached to its base. Further, the stamp application pen must be cared for as well. It is recommended that a pen be stored tip down in a cup or holder to allow the tip to stay moist and not dry out. Also, if a pen tip dries out, the pen must be stored tip down until it re-hydrates.

SUMMARY

In an aspect, a cosmetic stamp includes a stamping element including a stamping element body, a stamp that projects from the stamping element body in a first longitudinal direction, the stamp configured to stamp a user's skin, and a handle that projects from the stamping element body in a second longitudinal direction, the handle configured to be held by a user while applying the stamping element to the user's skin.

The cosmetic stamp may further include a second stamping element including a second stamping element body, a second stamp that projects from the second stamping element body in the first longitudinal direction, the stamp configured to stamp the user's skin, and a second handle that projects from the stamping element body in the second longitudinal direction, the handle configured to be held by the user while applying the stamping element to the user's skin.

The cosmetic stamp may further include a stamp compartment, wherein the handle and the second handle form a knob when the stamping element and the second stamping element are placed in the stamp compartment.

The handle may have a right eyebrow shape that is similar to a shape of the stamp, and the second handle may have a left eyebrow shape that is similar to a shape of the second stamp.

The cosmetic stamp may further include a stamp compartment and a compartment lid that is hingedly attached to the stamp compartment and includes a recess for receiving a stamping substance.

The cosmetic stamp may further include an ovular or egg-like shaped stamp compartment.

The stamping element may further include a projection extending from the stamping element body in the first longitudinal direction, and a stamp holder comprising an aperture for receiving the stamp.

The projection may be positioned entirely within a boundary formed by an edge of the stamping element body, and the stamp holder may be positioned entirely within another boundary formed by an edge of the projection.

The stamp may be removable and configured to be replaced by another stamp.

The stamp may be any one of a foam, a rubber, a plastic, or a polymer material.

In another aspect, a cosmetic stamp includes a stamp compartment, a stamping element received by the stamp compartment, and a stamping substance secured to the stamp compartment.

The stamp compartment may include a lid and the stamping substance may be secured to the lid of the stamp compartment.

The cosmetic stamp may further include a second stamping element including a second handle, wherein the stamping element comprises a handle, and the handle and the second handle form a knob when the stamping element and the second stamping element are placed in the stamp compartment.

The stamping element may include a handle and a stamp, and the handle may have a shape that is similar to a shape of the stamp.

The stamp compartment may include an ovular or egg-like shape.

The stamping element may further include a projection extending from a body of the stamping element, and a stamp holder including an aperture for receiving a stamp.

The projection may be positioned entirely within a boundary formed by an edge of the stamping element, and the stamp holder may be positioned entirely within another boundary formed by an edge of the projection.

In yet another aspect, a method of using a cosmetic stamp includes providing a cosmetic stamp including a stamp compartment, a stamping element received by the stamp compartment, and a stamping substance secured to the stamp compartment, removing the stamping element from the stamp compartment, pressing the stamping element to the stamping substance, and applying the stamping element to a user's skin.

The stamping element may include a removable stamp, and the method may further include replacing the removable stamp with another stamp.

The stamping element may include a first stamp holder and a first removable stamp, the cosmetic stamp may further include a second stamping element including a second stamp holder and a second removable stamp, and the method may further include removing the first stamp from the first stamp holder, removing the second stamp from the second stamp holder, reversing the orientation of the first stamp and placing the first stamp into the second stamp holder, and reversing the orientation of the second stamp and placing the second stamp into the first stamp holder.

DESCRIPTION OF THE SEVERAL VIEWS OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the invention is not limited to the precise arrangements and instrumentalities shown. The accompanying drawings, which are incorporated in and constitute a part of this specification, illustrate an implementation of systems and apparatuses consistent with the present invention and, together with the description, serve to explain advantages and principles consistent with the invention.

DETAILED DESCRIPTION OF THE INVENTION

Figure 1:
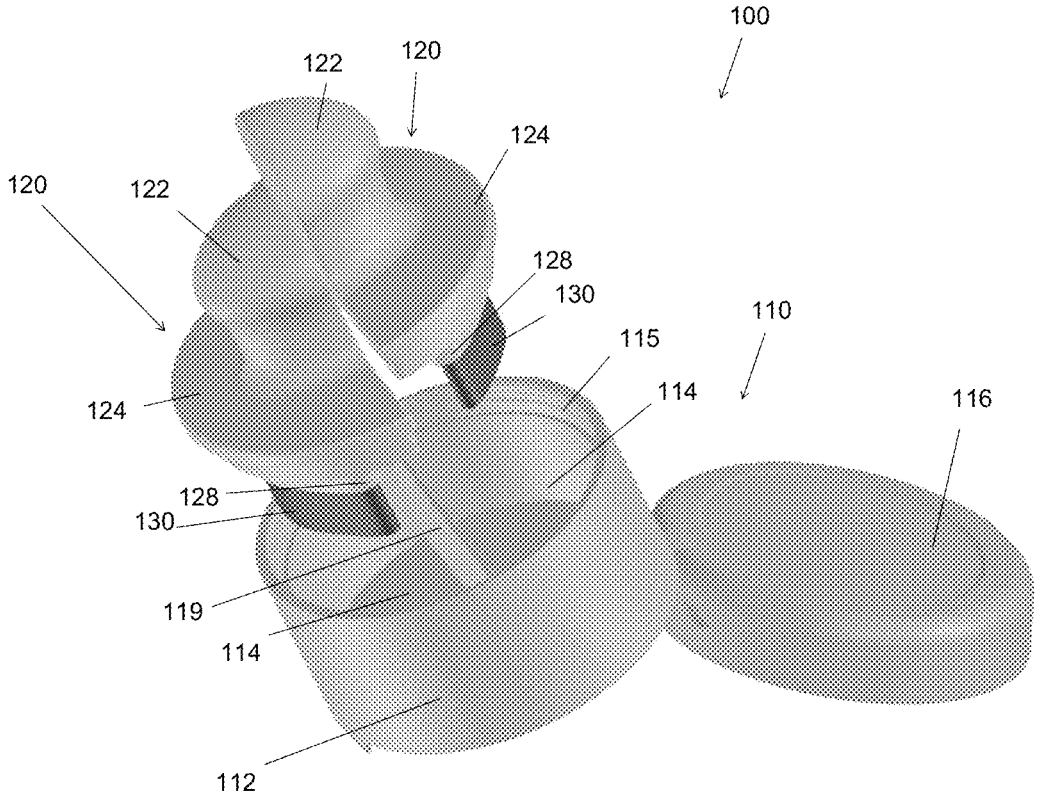
FIG. 1 is a diagram illustrating a perspective view of an example of a cosmetic stamp including one or more stamping elements.

Before explaining at least one example of the invention in detail, it is to be understood that the invention is not limited in its application to the details of construction and to the arrangements of the components set forth in the following description or illustrated in the drawings. The Figures and written description are provided to teach any person skilled in the art to make and use the inventions for which patent protection is sought. The invention is capable of other embodiments and of being practiced and carried out in various ways. Those skilled in the art will appreciate that not all features of a commercial embodiment are shown for the sake of clarity and understanding. Persons of skill in the art will also appreciate that the development of an actual commercial embodiment incorporating aspects of the present inventions will require numerous implementation—specific decisions to achieve the developer's ultimate goal for the commercial embodiment. While these efforts may be complex and time-consuming, these efforts nevertheless would be a routine undertaking for those of skill in the art having the benefit of this disclosure.

In addition, it is to be understood that the phraseology and terminology employed herein are for the purpose of description and should not be regarded as limiting. For example, the use of a singular term, such as, "a" is not intended as limiting of the number of items. Also the use of relational terms, such as but not limited to, "top," "bottom," "left," "right," "upper," "lower," "down," "up," "side," are used in the description for clarity in specific reference to the Figures and are not intended to limit the scope of the invention or the appended claims. Further, it should be understood that any one of the features of the invention may be used separately or in combination with other features. Other systems, methods, features, and advantages of the invention will be or become apparent to one with skill in the art upon examination of the Figures and the detailed description. It is intended that all such additional systems, methods, features, and advantages be included within this description, be within the scope of the present invention, and be protected by the accompanying claims.

FIG. 1 is a diagram illustrating a perspective view of an example of a cosmetic stamp 100 including one or more stamping elements 120. Referring to FIG. 1, the cosmetic stamp 100 includes a stamp compartment 110 for housing the one or more stamping elements 120.

In this example, the cosmetic stamp 100 is an eyebrow stamp for the application of a cosmetic eyebrow to a user's face. Also, in this example, two stamping elements 120 are used with one stamping element 120 having a shape for a right eyebrow and the second stamping element 120 having a different shape for a left eyebrow. However, It should be appreciated by one of ordinary skill in the art that the invention is not limited thereto. For example, the cosmetic stamp 100 may including only one stamping element 120 or more that two stamping elements 120. Also, the cosmetic stamp 100 may be used for different applications of cosmetic stamping such as for stamping a mustache or other feature to a user's skin. In addition, while stamping elements 120 may have different stamping shapes for a left or right eyebrow, or for different mustache shapes, it should be appreciated that stamping elements 120 may all have the same stamping shape.

Still referring to the example illustrated in FIG. 1, the stamp compartment 110 includes a compartment body 112, stamp receiving openings 114 for receiving the stamping elements 120, and a compartment lid 116 for covering the stamp compartment 110. As will be described in more detail in reference to FIG. 2, the stamp compartment 110 also houses the stamping substance 118, and the stamping substance 118 may be positioned on the underside of the compartment lid 116. In addition, the stamp compartment 110 includes an upper groove 115 for fittingly engaging with the stamp elements 120 and securing the stamp elements 120 to the stamp compartment 110. In this example, a middle wall 119 extends across a central longitudinal axis of the stamp compartment 110 and separates the stamp compartment 110 into two sections with left and right stamp receiving openings 114.

The cosmetic stamp 100 also includes stamping elements 120. Each of the one or more stamping elements 120 includes a handle 122 for holding the stamping element 120, a stamping element body 124 acting as another lid and covering the other side of the stamp compartment 110, a projection 126 (not illustrated in FIG. 1 but described in more detail below) for fittingly engaging with the upper groove 115 of the stamp compartment 110 and the middle wall 119, a stamp holder 128 having an aperture 129 (not illustrated in FIG. 1 but described in more detail below), and stamps 130 positioned in the aperture 129 of the stamp holder 128.

Figure 2:
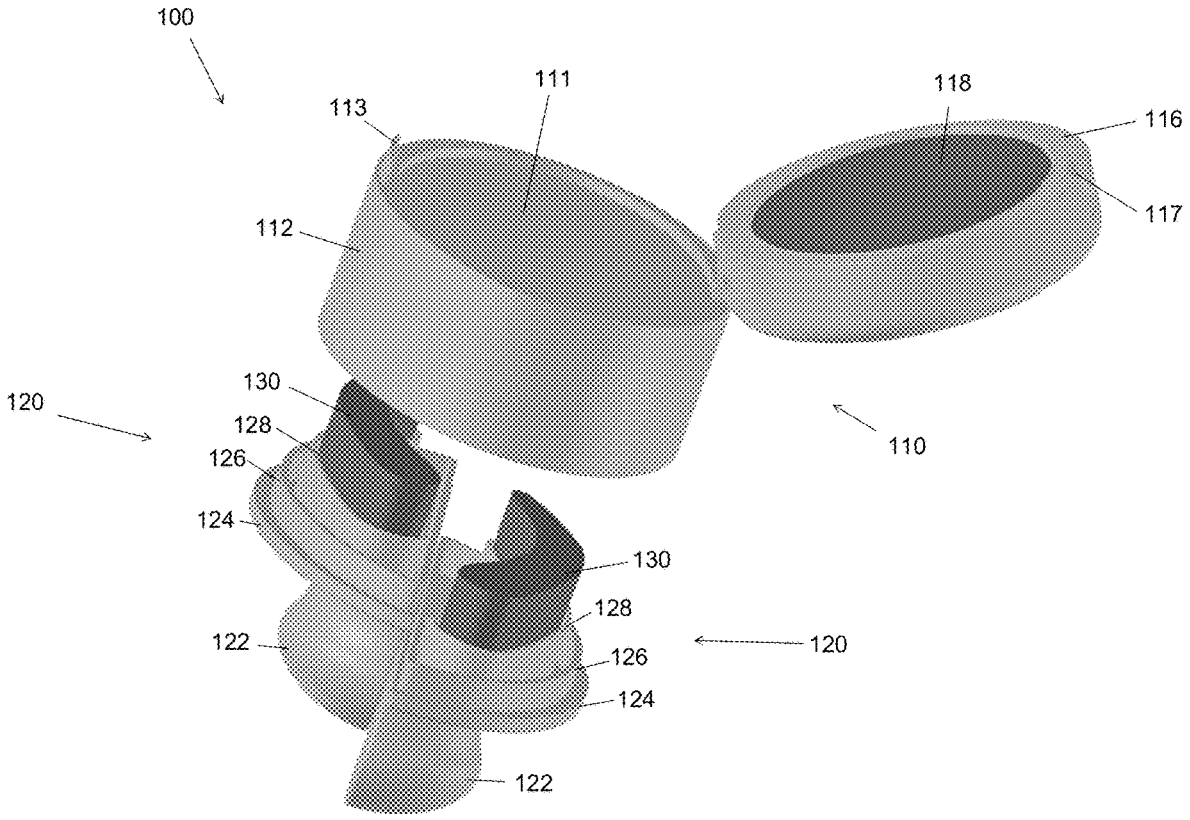
FIG. 2 is a diagram illustrating another perspective view of the example of the cosmetic stamp including one or more stamping elements.

FIG. 2 is a diagram illustrating another perspective view of the example of the cosmetic stamp 100 including the one or more stamping elements 120. As discussed above in reference to FIG. 1, the cosmetic stamp 100 includes the stamp compartment 110 having the compartment body 112 and the compartment lid 116.

The compartment lid 116 may hold the stamping substance 118 on an underside surface thereof. For example, the underside of the compartment lid 116 may include a depression for holding a plate (not shown) having the stamping substance 118, or the stamping substance 118 may be placed directly in the depression of the compartment lid 116. The plate is preferably a metal plate that is permanently attached in the depression of the compartment lid 116, for example, using glue or other adhesive, but may be a removable plate and may be formed of other materials such as plastic. The stamping substance may fill the entire plate up to the surface of the lid 116 such that the stamping substance forms a substantially flat surface with the underside of the lid 116. In a preferred example, the stamping substance is a compressed material which forms a solid surface that does not come off the plate until the user applies the face of the stamp 130 to the stamping substance 118.

FIG. 2 also illustrates the stamping elements 120 from a different perspective view. Each stamping element 120 includes the handle 122, the stamping element body 124, the projection 126, the stamp holder 128, and the stamp 130. The projection 126 may extend from an interior underside portion of the stamping element body 124 and may form a border around the stamp holder 128 and stamp 130.

Figure 3:
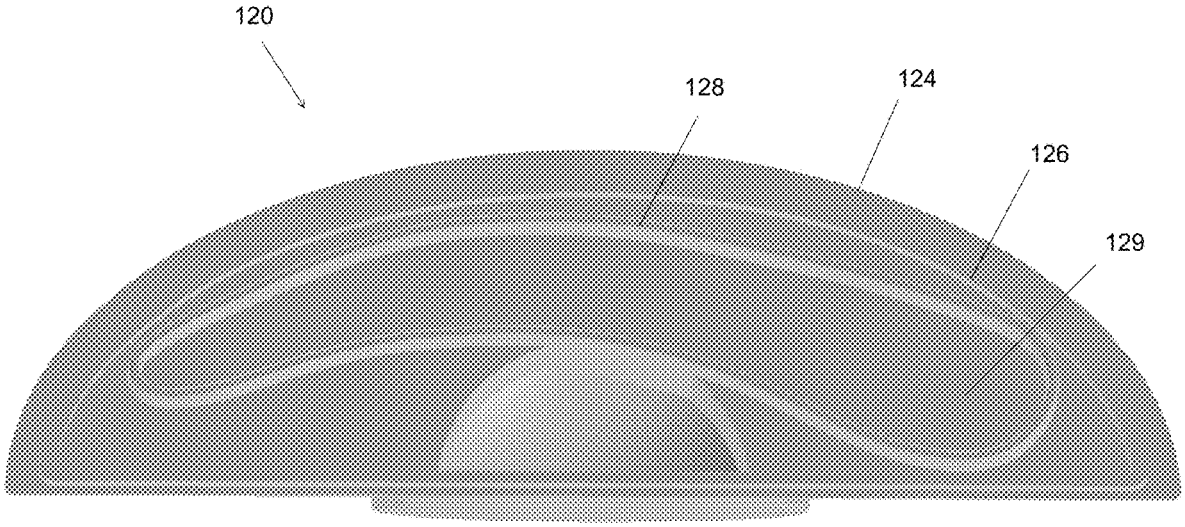
FIG. 3 is a diagram illustrating a bottom elevation view of an example of a stamping element without a stamp.
Figure 4:
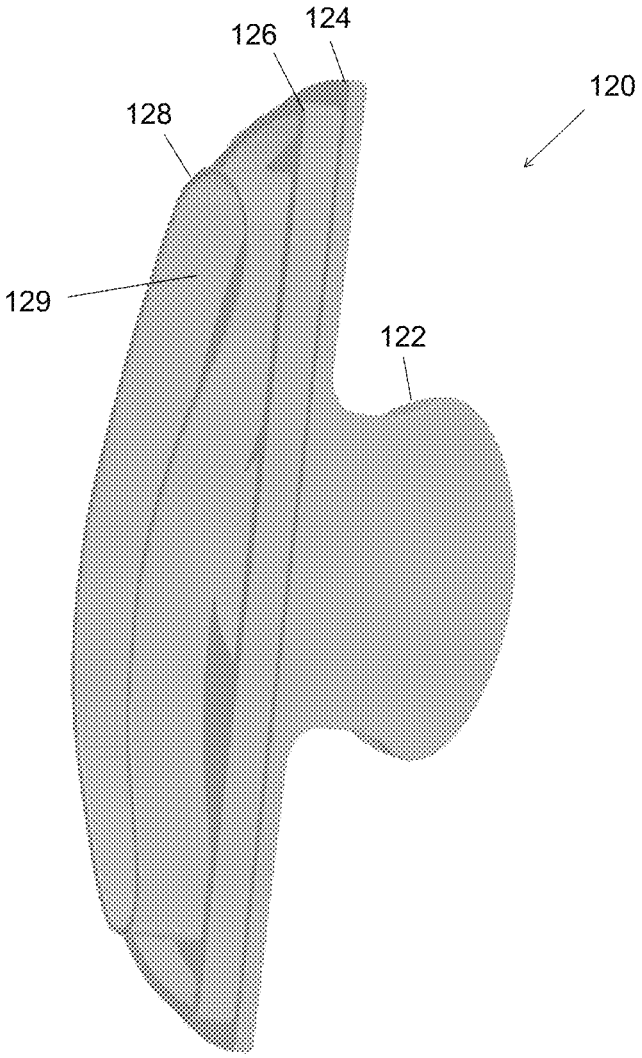
FIG. 4 is a diagram illustrating a perspective view of the example of the stamping element without a stamp.
Figure 5:
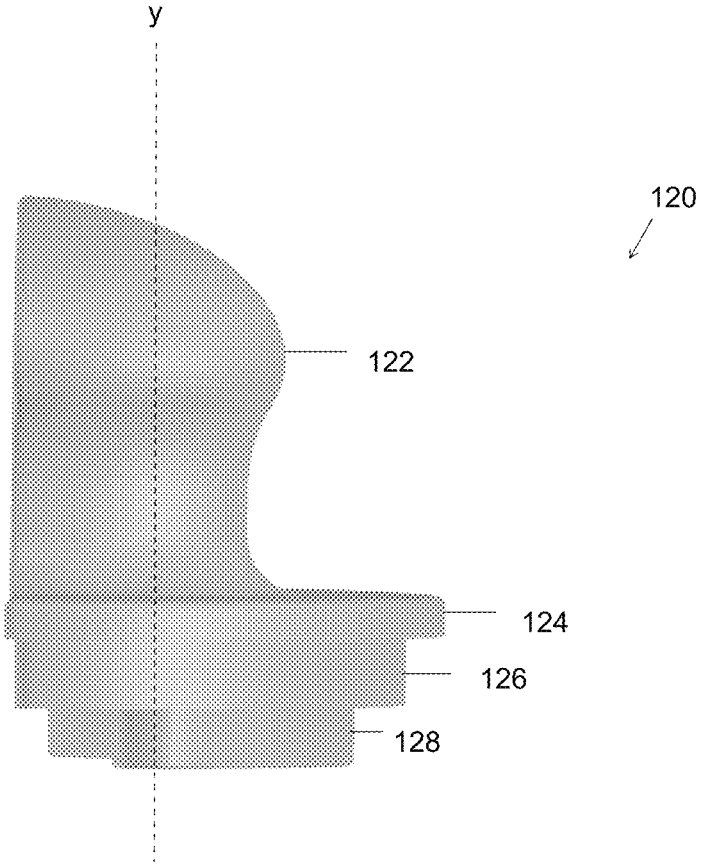
FIG. 5 is a diagram illustrating a side elevation view of the example of the stamping element without a stamp.

FIGS. 3-5 are diagrams illustrating a bottom elevation view, a perspective view, and a side elevation view of an example of a stamping element 120 without a stamp 130, respectively.

Referring to FIGS. 3 and 4, the projection 126 is fully enclosed within a border that is formed by the edge of the stamping element body 124, and the stamp holder 128 is fully enclosed within a border that is formed by the projection 126. Both the stamping element body 124 and the projection 126 may have an identical semi-circular or semi-ovular shape, with the projection 126 being smaller in size, so that two stamping elements 120 together form a full circular or full ovular shape. This full circular or ovular shape of the two stamping elements 120 corresponds to the shape of the compartment body 112 and the overall shape of the cosmetic stamp 100, as described in more detail below.

Referring to FIG. 5, a side elevation view of the stamping element 120 is illustrated. In this example, the stamping element body 124 extends farther outwardly and inwardly from a central axis y of the stamping element 120 than the handle 122, the projection 126, and the stamp holder 128. The projection 126 extends farther outwardly and inwardly from a central axis y than the stamp holder 128. Also, in this example, the stamp holder 128 may extend farther outwardly from a central axis y than the handle 122.

The handle 122 may have many different shapes and sizes for allowing a user to hold the stamping element 120. In an example, the handle 122 may have a substantially similar or identical shape and/or size as the stamp holder 128 or the stamp 130 but a longer height extension along the central axis y. The handle 122 may also have the same shape but a smaller size. By having the same or similar shape and/or size as the stamp holder 128 or stamp 130, a user may determine the shape and/or size of the stamp by simply examining the handle 122. For example, a user may determine the shape and/or size of a stamp 130 while the cosmetic stamp 100 is on the shelf of a retail store simply by looking at the handle 120 and without unsealing the cosmetic stamp 100 or opening the stamp compartment 110. Further, in the preferred example, the stamping element 120, except for the stamp 130, is made entirely of transparent plastic material so that a user may look through the stamping element body 124 to view the stamp 130 without opening the stamp compartment 110.

Figure 6:
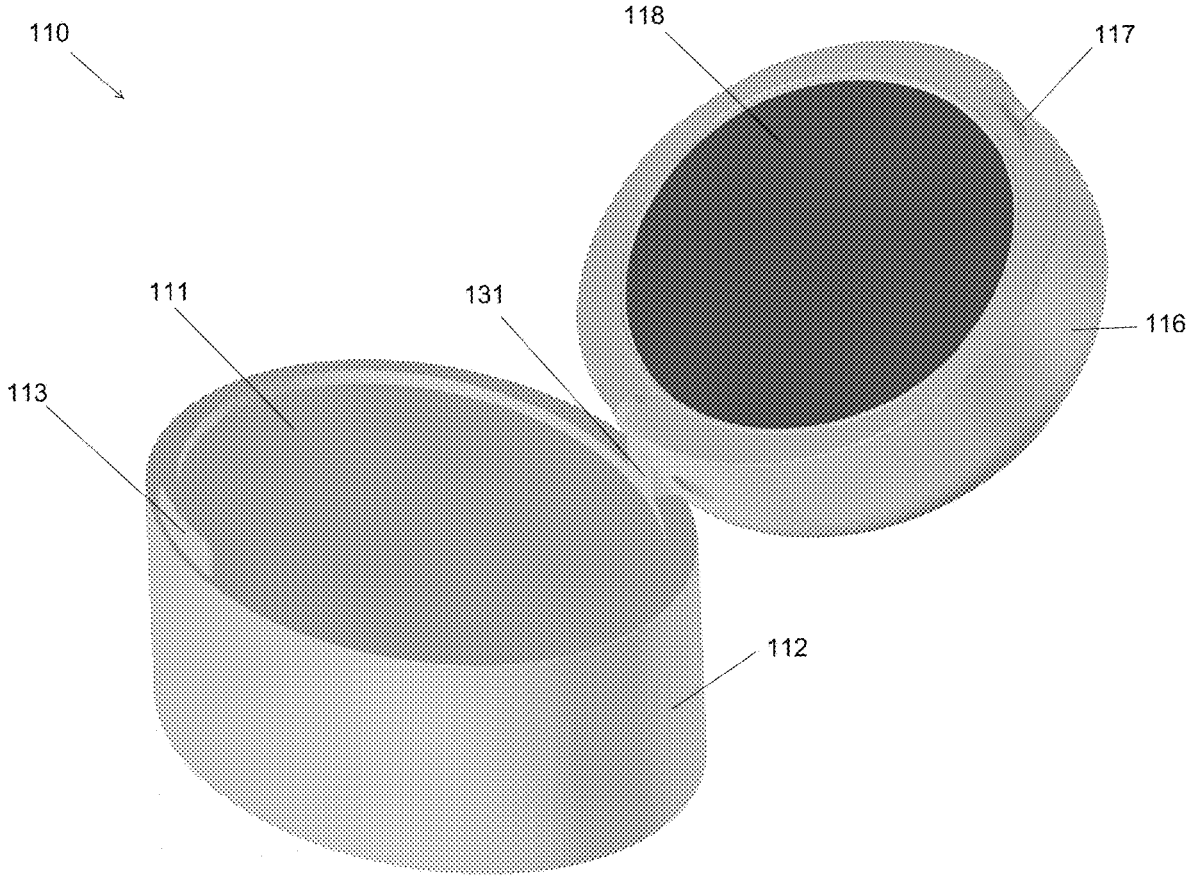
FIG. 6 is a diagram illustrating a bottom perspective view of an example of a stamp compartment of a cosmetic stamp.

FIG. 6 is a diagram illustrating a bottom perspective view of an example of a stamp compartment 110 of a cosmetic stamp 100. The cosmetic stamp 100 includes the stamp compartment 110 having the compartment body 112 and the compartment lid 116 holding the stamping substance 118. The stamp compartment 110 also includes a hinge 131 for attaching the compartment lid 116 to the compartment body 112, and securing elements 113, 117 for securing the compartment lid 116 to the compartment body 112 in a closed configuration.

Also illustrated in FIG. 6, the stamp compartment 110 includes a flat surface 111 that is positioned across of the surface holding the stamping substance 118. In this example, the flat surface 111 is on the bottom of the compartment body 112 and across from the top of the compartment lid 116, as illustrated in the figures. However, it should be appreciated that the stamping substance 118 is interchangeable in position with the flat surface 111 so that the flat surface 111 can also be positioned on the top of the compartment lid 116 and the stamping substance 118 on the bottom of the compartment body 112. In an example, the flat surface 111 may also include a permanently attached or removable mirror or reflective element (not shown). In addition, to keep the mirror or reflective element clean and separate from the stamping substance 118, a paper such as a separating tissue having the same shape as the surfaces may be placed between the two surfaces.

Figure 7:
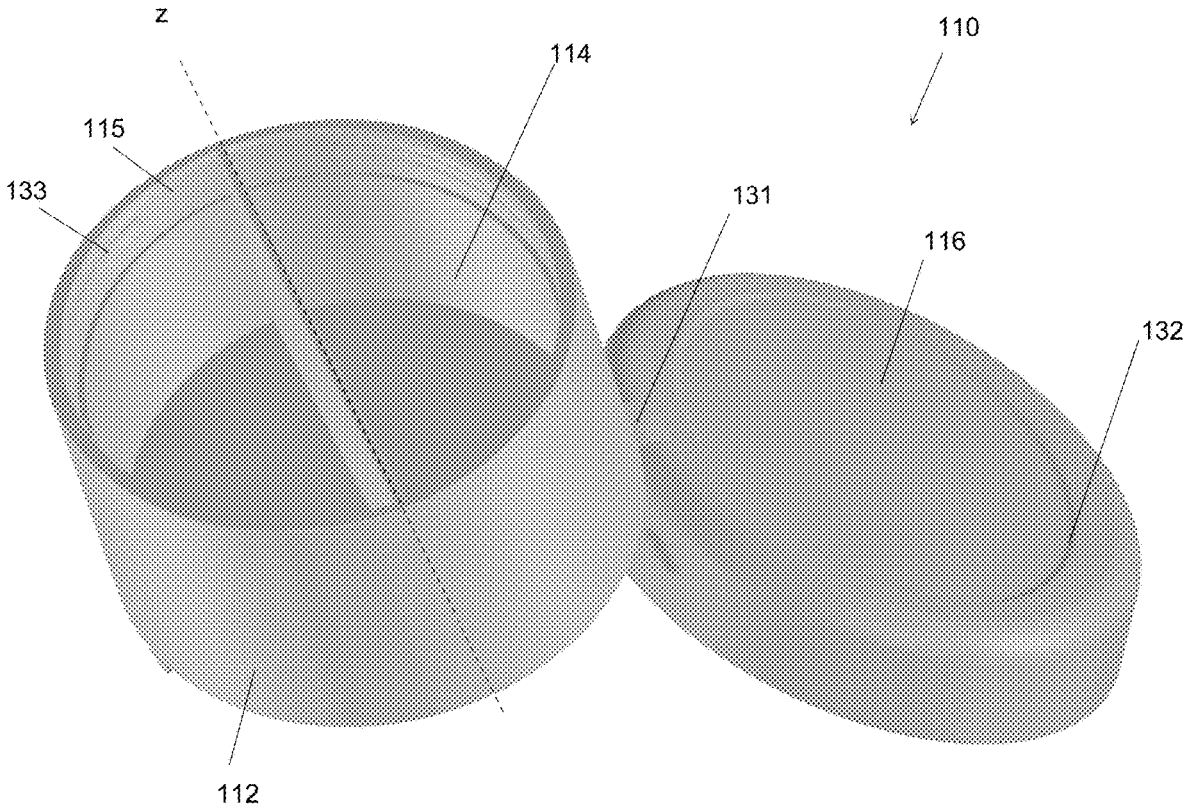
FIG. 7 is a diagram illustrating a top perspective view of the example of the stamp compartment of the cosmetic stamp.

FIG. 7 is a diagram illustrating a top perspective view of the example of the stamp compartment 110 of the cosmetic stamp 100. Because, in the preferred example, each of the stamps 130 has a crescent-like shape similar to that of an eyebrow, the cosmetic stamp's 100 ovular, egg-like shape provides the most compact configuration for enclosing each of the stamps 130. In the preferred example, the compartment body 112 extends father along a central longitudinal axis z parallel with the middle wall 119. Accordingly, the two crescent-like shapes of the two stamps 130 when placed within the stamp receiving openings 114 and with their concave sides facing one another are most compactly fit in a compartment body 112 having an ovular, egg-like shape.

Still referring to FIG. 7, the compartment body 112 includes an indentation 133 that extends along the upper groove 115 for receiving one or more bumps (not shown) formed on the outer surface of the projection 126 of the stamping element 120. The interaction of the one or more bumps with the indentation 133 further secures the attachment between the stamping element 120 and the compartment body 112. That is, the one or more bumps can fittingly engage with the indentation 133 to further secure the stamping element 120 to the compartment body 112. Also, a border 132 is formed on an outer surface of the lid 116 for separating the lid 116 into an inner circular surface and an outer circular surface. In an example, a label for the cosmetic stamp 100 may be adhered to the inner circular surface, and the inner circular surface may be indented with respect to the outer circular surface.

Figure 8:
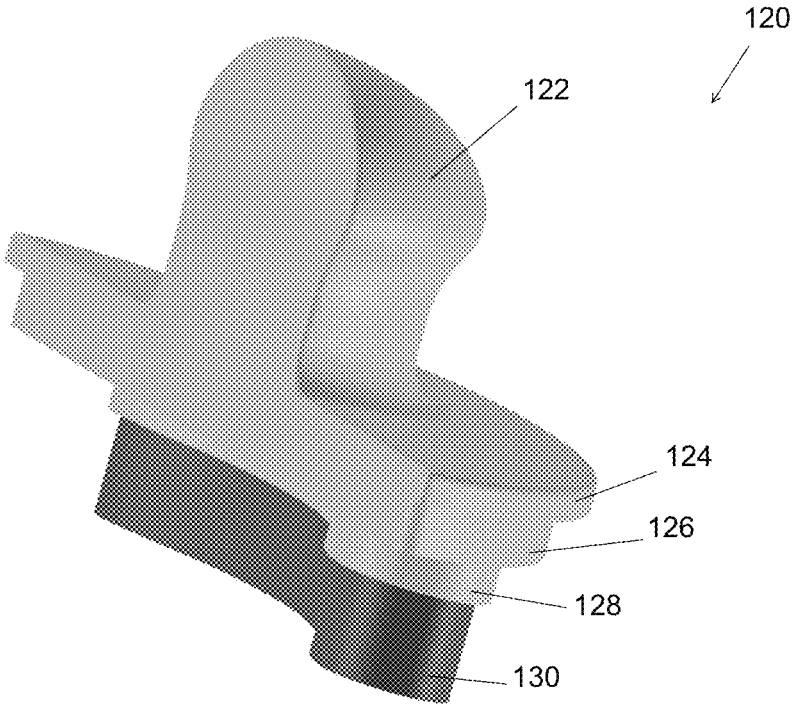
FIG. 8 is a diagram illustrating a perspective view of the example of the stamping element of the cosmetic stamp with a stamp.
Figure 9:
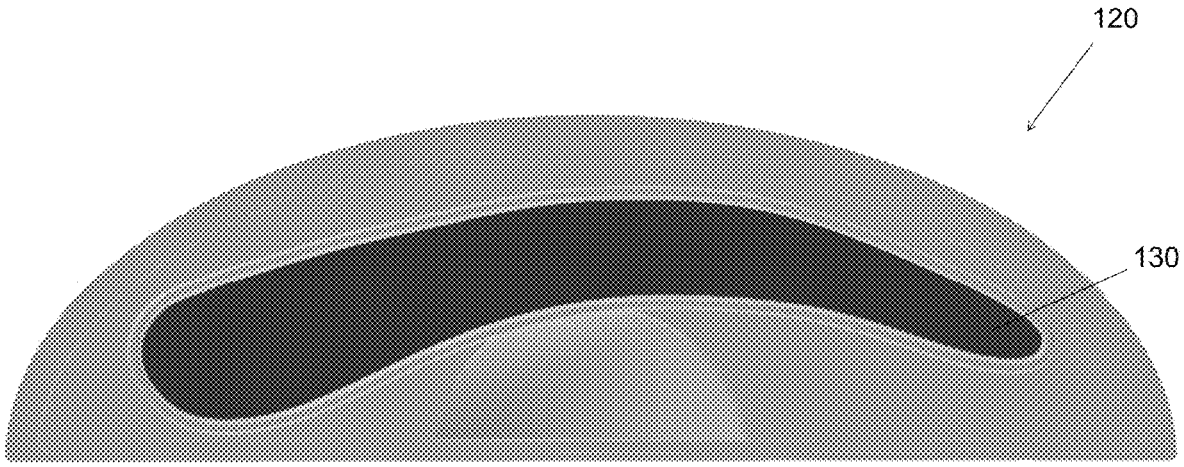
FIG. 9 is a diagram illustrating a bottom elevation view of the example of the stamping element of the cosmetic stamp with a stamp.

FIG. 8 is a diagram illustrating a perspective view of the example of the stamping element 120 of the cosmetic stamp 100 with a stamp 130. FIG. 9 is a diagram illustrating a bottom elevation view of the example of the stamping element 120 of the cosmetic stamp 100 with a stamp 130.

Referring to FIGS. 8 and 9, a stamp 130 is removably inserted within the stamp holder 128 of the stamping element 120. The stamp 130 has a substantially similar shape and size as the stamp holder 128 so that, in response to being inserted into the stamp holder 128, the stamp 130 is securely attached to the stamping element 120 by the friction force between the stamp 130 and the stamp holder 128. Because two stamping elements 120 may each have a stamp shape for a right and left eyebrow, respectively, and because the stamp 130 has reversible, mirror-image shapes on opposite sides with one side being for a right eyebrow and the other side being for a left eyebrow, an eyebrow stamp 130 for one stamping element 120 can be used with the other stamping element 120. That is, each of the stamps 130 are reversible stamps that can be interchanged between the stamping elements 120 for convenience to the user. Further, the stamps 130 are removable and may be replaced by different stamps 130 altogether.

In a preferred example, the stamps 130 are made from a foam material and have a flat and smooth stamping surface. In another example, the stamps 130 may be made from other materials such as rubber, plastic, or a polymer material. Also, the stamps 130 may have a textured stamping surface such as a texture of different hairs of an eyebrow. In yet another example, the stamps 130 may have different stamping surfaces on opposite sides with one side having a substantially similar shape and size as the stamp holder 128 for fittingly engaging thereto, and the other side having a different shape and size. The side having the substantially similar shape and size as the stamp holder 128 may be thicker than the side having a different shape and size so that it engages with the stamp holder 128 when that stamping surface is being used.

Figure 10:
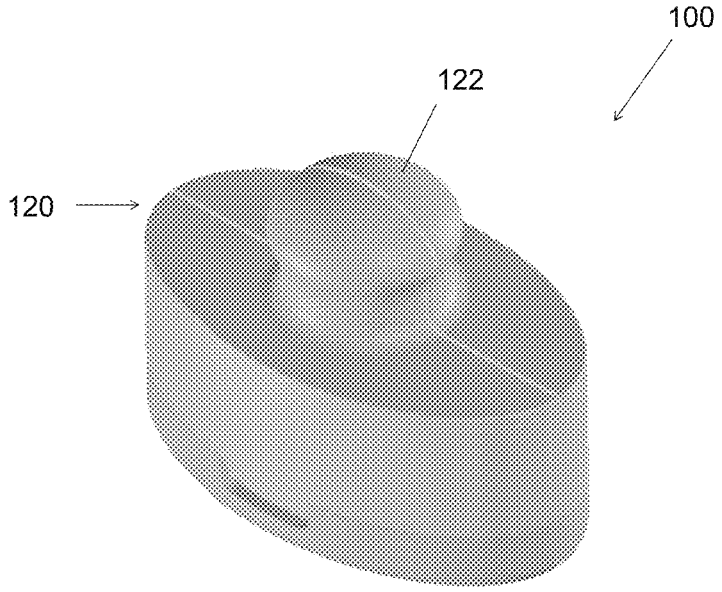
FIG. 10 is a diagram illustrating a perspective view of an example of a cosmetic stamp in a closed configuration.
Figure 11:
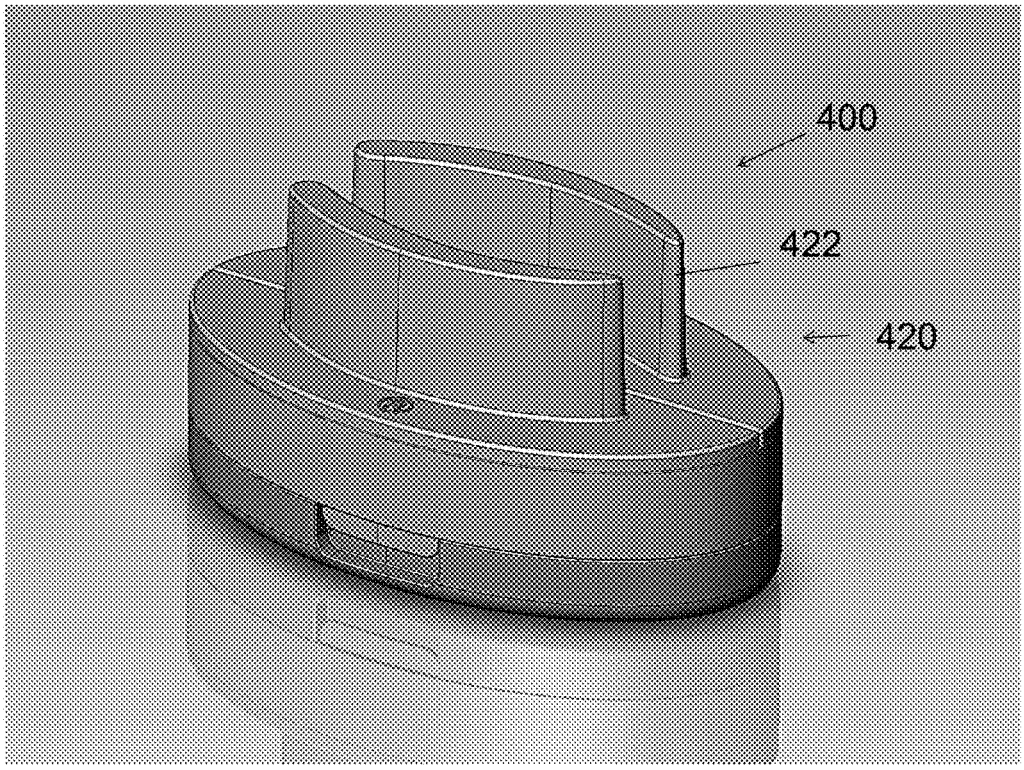
FIG. 11 is a diagram illustrating a perspective view of an example of a cosmetic stamp in a closed configuration.
Figure 12:
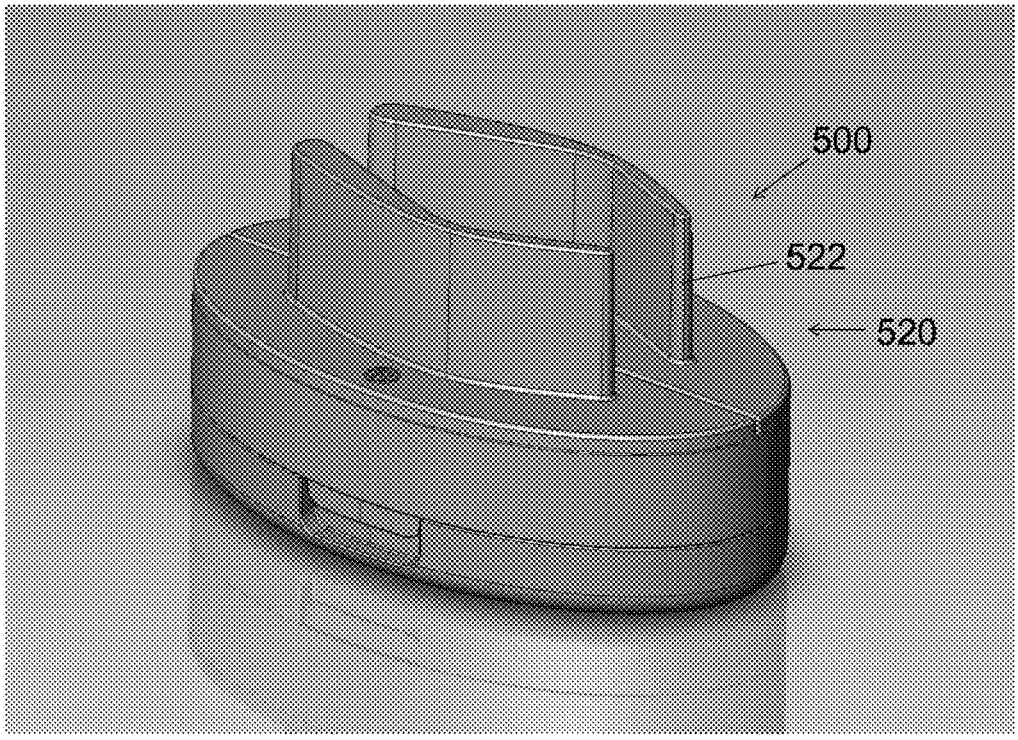
FIG. 12 is a diagram illustrating a perspective view of an example of a cosmetic stamp in a closed configuration.

FIGS. 10, 11, and 12 are diagrams illustrating perspective views of examples of a cosmetic stamp 100, 400, 500 in a closed configuration. Referring to FIG. 10, the cosmetic stamp 100 may have stamping elements 120 with handles 122 that come together to form a knob-like shape. Referring to FIGS. 11 and 12, the cosmetic stamp 400, 500 may have stamping elements 420, 520 with handles 422, 522 that have the same shape and size as the stamp of the stamping elements 420, 520. A cosmetic stamp 400 may be used for applying a regular eyebrow shape while a cosmetic stamp 500 may be used for applying a delicate eyebrow shape. As discussed above, in an example, the stamping elements 120, 420, 520 may be made of entirely transparent material so that a user can see the stamp that is held by the stamping elements 120, 420, 520 while the cosmetic stamp 100, 400, 500 is in the closed configuration.

In an example, the cosmetic stamp 100 may be provided to include the stamp compartment 110 and one or more stamping elements 120. A user may apply the stamp by removing the stamping element 120 from the stamp compartment 110, opening the lid 116, pressing the face of the stamp 130 of the stamping element 120 to the stamping substance 118, and applying the stamp 130 to their skin. For example, a user may use a mirror such as a mirror on the flat surface 111 while applying the stamp 130 to their skin. A user may repeat the steps using a second stamping element 120 for applying a second stamp shape to their skin. For example, the first stamp shape may be that of a right eyebrow and the second stamp shape may be that of a left eyebrow. In response to a wearing of the stamp 130, a user may replace the stamp with another stamp that is bought separately or in a package including a number of different replaceable stamps 130. In another example, in response to a wearing of two stamps 130 of two stamping elements 120, a user may reverse the orientation of the two stamps 130 so that their used faces are directed inwardly with respect to the stamp holders 128, and may switch the stamps 130 so that they are used with the other stamping element 120.

In an aspect, it should appreciated that advantages of the cosmetic stamp 100 include providing an all-in-one kit including one or more stamps and a stamping substance. Other advantages include providing a product that is easy to use and configured to apply a cosmetic stamp quickly and without creating a mess. In addition, the cosmetic stamp 100 is easy to clean and has replaceable stamps 130. Further, the cosmetic stamp 100 is easily portable, may be grasped by a user using a single hand, and is easy to carry. It should be appreciated by those skilled in the art that the advantages of the cosmetic stamp 100 are not limited to those described herein and are merely examples of the advantages of the invention.

It will be appreciated by those skilled in the art that changes could be made to the embodiments described above without departing from the broad inventive concept thereof. It is understood, therefore, that the invention disclosed herein is not limited to the particular embodiments disclosed, but it is intended to cover modifications within the spirit and scope of the present invention as defined by the appended claims.

The invention claimed is:

1. A cosmetic stamp, comprising:

a stamp compartment having a substantially ovular or egg-like shaped contour and a compartment lid, the compartment lid having an underside and a depression in the underside configured to hold a stamping substance, which comprises a compressed material having a solid surface;

a first stamping element, comprising:

a first stamping element body having a first contour;

a first skin stamp that projects from the stamping element body in a first longitudinal direction, the first skin stamp having a first user contact end which transfers the stamping substance to a user's skin upon being pressed to the user's skin and is configured to be the shape of one of a user's right or left eyebrow; and;

a first handle that projects from the first stamping element body in a second longitudinal direction, the first handle configured to be held by a user while applying the stamping element to the user's skin, and similar in shape with the shape of the first skin stamp a second stamping element, comprising:

a second stamping element body having a second contour;

a second skin stamp that projects from the second stamping element body in the first longitudinal direction, the second skin stamp having a second user contact end which transfers the stamping substance to the user's skin upon being pressed to the user's skin and is configured to be the shape of the other of a user's right or left eyebrow; and a second handle that projects from the second stamping element body in the second longitudinal direction, the second handle having a shape similar to the shape of the second skin stamp and configured to be held by the user while applying the stamping element to the user's skin separately from the first stamping element, wherein the first and second handles are separated from one another during application, wherein each of the first and second stamping elements further comprises a respective projection extending from a respective one of the first and second stamping element bodies in the first longitudinal direction, defining an aperture for receiving the first and second skin stamps; and wherein the projection is positioned entirely within a boundary formed by a first edge of the respective one of the first and second stamping element bodies, and the stamp holder is positioned entirely within another boundary formed by a second edge of the projection; and when the first and second stamping elements are simultaneously received in the stamp compartment, the first and second contours of respective first and second stamping element bodies combine to form an outer contour that is substantially the same as the outer contour of the stamp compartment.

2. The cosmetic stamp of claim 1, wherein the compartment lid is hingedly attached to the stamp compartment, and wherein the depression is configured for holding a plate having a stamping substance or for receiving a stamping substance.

3. The cosmetic stamp of claim 1, wherein at least one of the first skin stamp or the second skin stamp are removable and configured to be replaced by another stamp.

4. The cosmetic stamp of claim 1, wherein at least one of the first skin stamp or the second skin stamp are is any one of a foam, a rubber, a plastic, or a polymer material.

5. The cosmetic stamp of claim 1, wherein the first handle and the second handle form a knob when the first stamping element and the second stamping element are placed in the stamp compartment.

6. The cosmetic stamp of claim 1, wherein the stamp compartment includes a middle wall extends across a central longitudinal axis of the stamp compartment and separates the stamp compartment into two sections each section configured to receive one of the first or second skin stamps.

7. The cosmetic stamp of claim 6, wherein the stamp compartment includes an upper groove for fittingly engaging with the first and second stamp elements.

8. The cosmetic stamp of claim 7, wherein the first stamping element includes projections for fittingly engaging with the upper groove of the stamp compartment and the middle wall.

9. The cosmetic stamp of claim 1, wherein the depression holds a metal plate or a plastic plate having the stamping substance or receiving the stamping substance directly.

10. The cosmetic stamp of claim 1, the stamp compartment includes a flat surface that is positioned across a surface holding the stamping substance, and the flat surface includes a permanently attached or removable reflective element.

11. The cosmetic stamp of claim 10, wherein the reflective element is mirror.

12. The cosmetic stamp of claim 1, wherein first and second stamping element bodies each act as a lid to the stamp compartment when the first and second skin stamps are received within the compartment.

13. The cosmetic stamp of claim 1, wherein the device comprises transparent plastic material.

14. The cosmetic stamp of claim 1, wherein the first stamping element and the second stamping element are pre-formed separately from one another.

15. The cosmetic stamp of claim 1, wherein the stamping substance fills in the depression such that the stamping substance forms a flat surface with the underside.

* * * * *